US005749790A

United States Patent [19]

Van Alen, II et al.

[11] Patent Number: 5,749,790

[45] Date of Patent: May 12, 1998

[54] ADJUSTABLE GOLF CLUB

[75] Inventors: James L. Van Alen, II; Robert B. Van Alen; Jeanne B. Van Alen; James L. Van Alen, Jr., all of Newtown Square, Pa.; Alexander Van Alen, Fort Collins, Colo.

[73] Assignee: Arrowhead Innovations Corporation, Newtown Square, Pa.

[21] Appl. No.: 714,473

[22] Filed: Sep. 16, 1996

[51] Int. Cl.[6] ..... A63B 53/06; A63B 53/16

[52] U.S. Cl. ..... 473/245; 473/313; 473/314; 473/336; 473/341

[58] Field of Search ..... 473/244, 245, 473/246, 247, 248, 313, 340

[56] References Cited

U.S. PATENT DOCUMENTS 2,155,830 4/1939 Howard ..... 473/246

2,932,515 4/1960 May ..... 473/248

*Primary Examiner*—Jessica Harrison

*Assistant Examiner*—Stephen L. Blau

*Attorney, Agent, or Firm*—John F. A. Earley; John F. A. Earley, III; Harding, Earley, Follmer & Frailey

[57] ABSTRACT

An adjustable golf club having means for adjusting the balance of the club and means for adjusting the alignment angle of the club. A club head is attached to the connection end of the shaft by connecting means at a connection point along the heel-to-toe axis and at a line-of-play alignment angle and a heel-to-toe alignment angle. The connecting means includes a slide fixed to the connection end of the shaft and a socket in the top portion of the club head. The balance of the club can be adjusted by linearly moving the slide along the heel-to-toe axis in the socket. The line-of-play alignment angle of the shaft can be adjusted by rotatably moving the slide in the socket. After the club is adjusted, the slide is secured in the socket by locking means to prevent the club from deviating from the desired adjusted configuration during play. A method of putting a golf ball with the above-provided adjustable putter. The adjustable putter is provided to the golfer. The golfer adjusts the balance and line-of-play alignment angle of the club to the golfer's satisfaction. The golfer then strikes the golf ball with the adjusted putter.

21 Claims, 5 Drawing Sheets

ADJUSTABLE GOLF CLUB

FIELD OF THE INVENTION

The present invention relates to an adjustable golf club, and more particularly, an adjustable golf putter having means for adjusting the balance of the club head and means for adjusting the alignment angle of the shaft.

BACKGROUND OF THE INVENTION

A golf club has many design features such as the size, weight, and shape of the head, and the rigidity, straightness, length and alignment of the shaft. Golfers often switch golf clubs, in particular the putter, to better suit their physical characteristics or swing technique. While many commercial brands of standard golf clubs are available having different design characteristics, changing golf clubs frequently is expensive.

Some adjustable golf clubs are known. However, under current United States Golf Association (U.S.G.A.) Rule 4-1a(i), only putters may be designed to be adjustable, except for weight, provided that all configurations of adjustment conform with the Rules. Phillips U.S. Pat. No. 5,348,295 and Jarvis U.S. Pat. No. 4,569,523 each appear to disclose a golf putter with a shaft which may be adjusted about a pivot to change the "heel-to-toe" alignment and/or the "line-of-play" alignment of the shaft. As used herein, the "heel-to-toe" alignment and "line-of-play" alignment are defined consistent with the U.S.G.A. Rules of Golf 1996, Appendix II, rule 4.1b, FIGS. II and III, as follows: "heel-to-toe" alignment is the projection of the straight part of the shaft on to the vertical plane through the toe and heel; "line-of-play" alignment is the projection of the straight part of the shaft on to the vertical plane along the intended line of play.

Under U.S.G.A. rule 4.1b, the "heel-to-toe" alignment must be at least 10 degrees from vertical and the "line-of-play" alignment must be no greater than 20 degrees from vertical in either direction. Since the above-described adjustable putters may be adjusted into configurations of alignment different than those proscribed in U.S.G.A. rule 4.1b, such known adjustable putters do not conform with U.S.G.A. rules and are therefore illegal in U.S.G.A. sponsored competition. Therefore, it would be desirable to provide a putter having a shaft alignment which may be adjusted only within the ranges proscribed by the U.S.G.A. rules.

Further, no known adjustable golf putters provide both shaft alignment adjustment and adjustment or movement of the connection point between the shaft and the club head along the heel-to-toe axis. Movement of the connection point between the shaft and the club head along the heel-to-toe axis adjusts the "balance" of the club. Therefore, it would also be desirable to provide a putter having "alignment" as well as "balance" adjustment.

Additionally, under U.S.G.A. Rules 4-1a(i) and (ii), a putter may be adjustable provided that the adjustment cannot be readily made and that all adjustable parts are firmly fixed and there is no reasonable likelihood of them working loose during a round. Therefore, it would also be desirable to provide a putter having the aforementioned adjustability but which also complies with all U.S.G.A. rules relating the design of clubs.

SUMMARY OF THE INVENTION

It is therefore an object of the present invention to provide a putter having a shaft alignment which may be adjusted only within the ranges proscribed by the U.S.G.A.

It is a further object of the present invention to provide a putter having a connection point between the shaft and the head which may be adjusted along the heel-to-toe axis so that the "balance" of the putter may be adjusted.

It is an additional object of the invention to provide a putter having alignment and balance adjustability but which also complies with all U.S.G.A. rules relating the design of clubs.

These and other objects of the present invention are achieved by providing a golf putter having alignment and balance adjustability. The adjustable putter comprises a club head having a ball striking surface, a heel, a toe, a sole, a top surface, and a heel-to-toe axis. A shaft having a grip end and a connection end is connected to the head at a connection point along the heel-to-toe axis.

The connection means comprises a slide fixed to the connection end of the shaft and an elongate socket in the top surface of the club head. The socket has an axis that extends along or is parallel to the heel-to-toe axis. The slide orients the shaft at a heel-to-toe alignment angle of 10 degrees or greater from vertical.

A guide for guiding movement of the slide may be provided in the socket. The guide preferably comprises a cylindrical rod fixed in the socket at opposed ends and extending along the central axis of the socket and has a shape complimentary with the slide.

The slide is preferably a cylindrical segment having a hollow, cylindrical inner surface with a diameter greater than or equal to the diameter of the cylindrical rod. Clamping means prevent linear or rotational movement of said slide in said socket.

The adjustable putter also includes balance adjustment means for adjusting the connection point of the club head in infinite increments along the heel-to-toe axis of the club to adjust the balance of the club head.

The adjustable putter further includes alignment adjustment means for adjusting the line-of-play alignment angle of the shaft in infinite increments.

The club head comprises a first piece and a second piece forming a two-piece, interlocking construction. Each piece has a groove formed on opposed mating surfaces along the heel-to-toe axis. The socket is formed by the grooves when the first and second pieces are interlocked.

The club head also has means for interlocking the first and second pieces forming the club head and the socket. The socket has a diameter equal to or smaller than the diameter of the slide when the interlocking means are tightened fully without the slide being located in the socket.

The connecting means includes a stop for limiting adjustment of the line-of-play alignment angle of the shaft to plus or minus 20 degrees. The stop comprises opposed walls defining a slot formed in the top surface of the club head along or parallel to the axis of the socket.

DESCRIPTION OF A PREFERRED EMBODIMENT OF THE INVENTION

Figure 1:
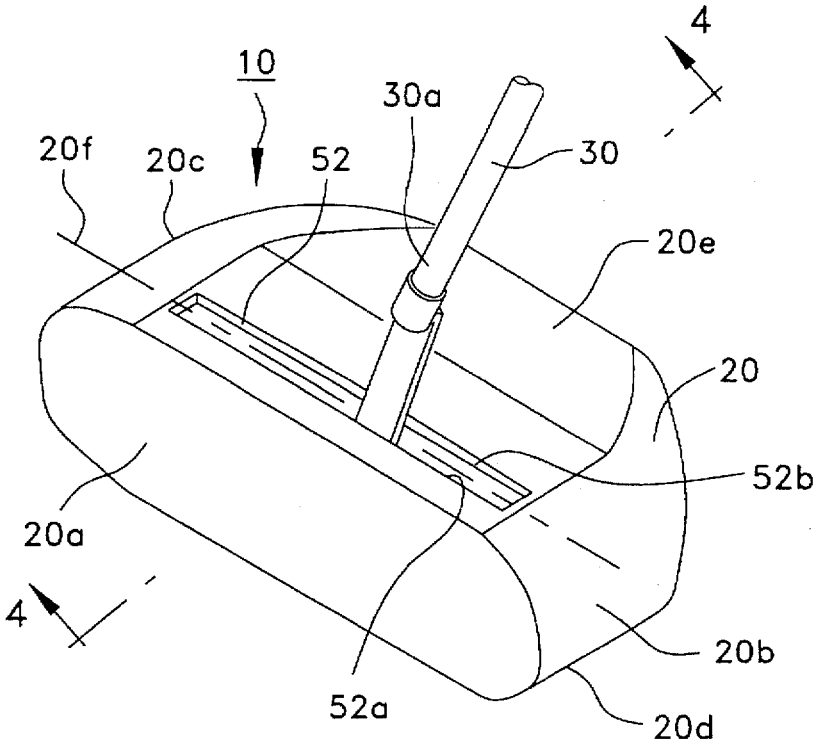
FIG. 1 is a perspective view of an embodiment of a putter head and connection end of a shaft of the present invention.

The adjustable putter and method of putting according to preferred embodiments of the present invention are described with reference to FIGS. 1–10 wherein like reference numerals represent similar features of each illustrated embodiment. The drawings are provided for illustrative purposes only and are not meant to limit the scope of the present invention.

The adjustable golf putter 10 according to a preferred embodiment of the invention has a head 20 and an elongate shaft 30 as seen in FIGS. 1–5. Referring to FIG. 1, the head 20 has a ball striking surface 20*a*, a heel 20*b*, a toe 20*c*, a sole 20*d*, and top surface 20*e*. A heel-to-toe axis 20*f* runs from the heel to toe of the club.

Figure 3:
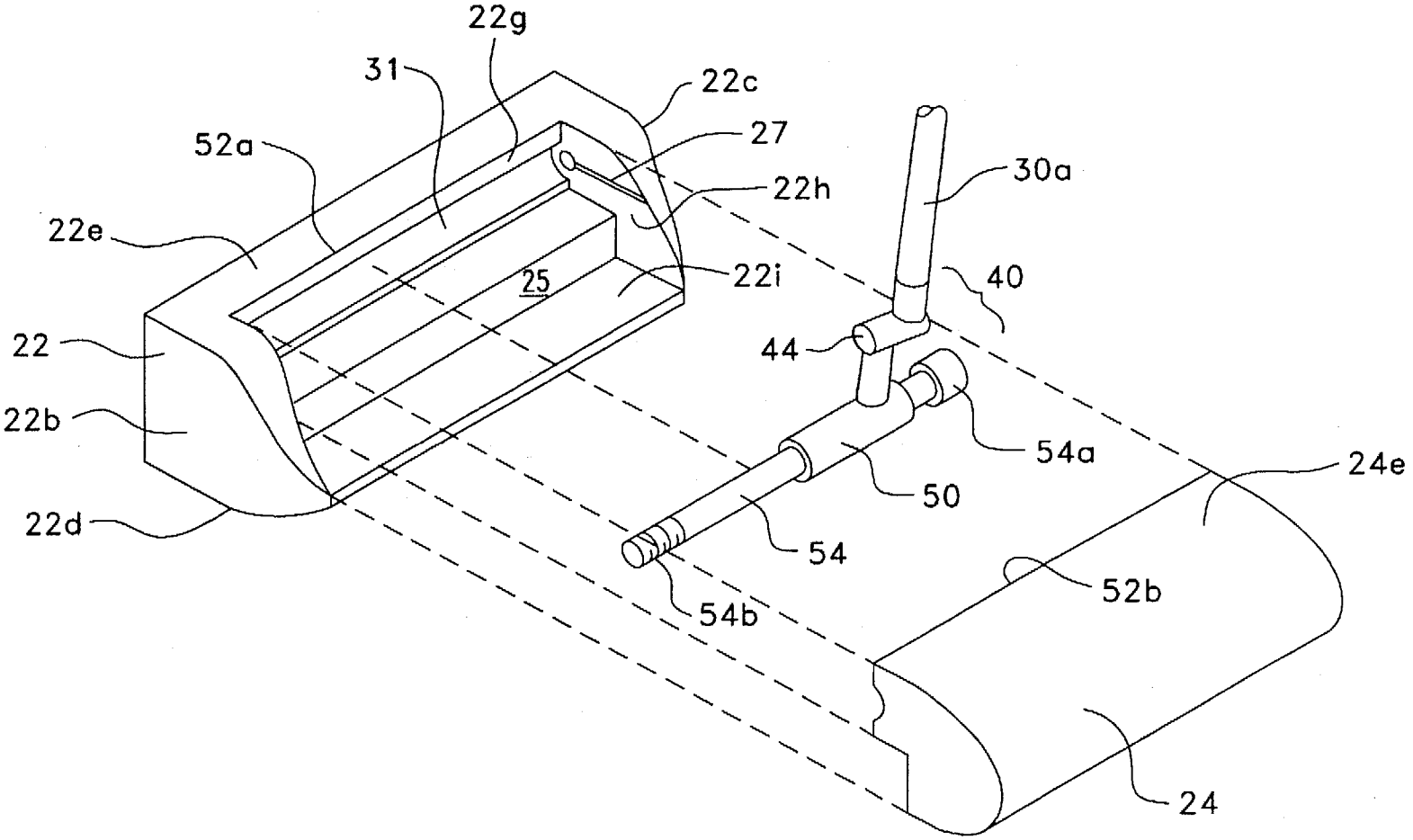
FIG. 3 is an exploded assembly view of a putter head and connection end of a shaft of the present invention.

The connection end 30*a* of the shaft 30 is connected to the club head 20 at a connection point along the heel-to-toe axis by connecting means, designated generally as reference numeral 40 as seen in FIG. 3. The shaft forms a "heel-to-toe" alignment angle relative to the club head, graphically illustrated as angle "Y" in FIG. 5. The shaft also forms a "line-of-play" alignment angle relative to the club head, graphically illustrated as angle "X" in FIG. 4.

Figure 2:
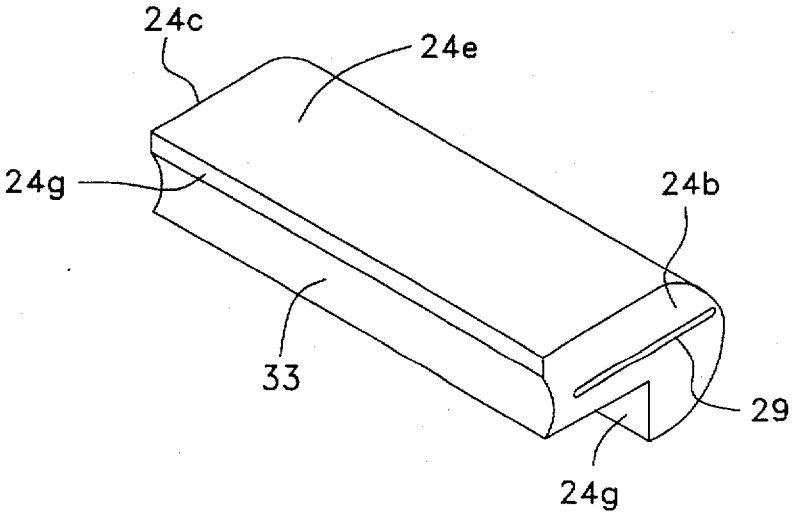
FIG. 2 is a perspective view of the back or second piece of the putter head of an embodiment of the invention.
Figure 4:
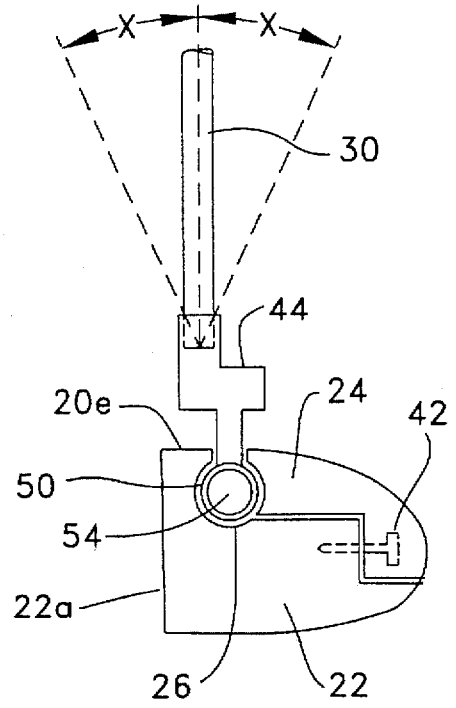
FIG. 4 is a cross-section taken along lines 4-4 of the putter head shown in FIG. 1.

The club head 20 has a two-piece 22, 24 interlocking construction. Referring to FIGS. 2–4, the first piece 22 has a generally flat front which forms the ball striking surface 22*a* of the club head. The first piece 22 has a top surface 20*e* which, together with the top surface 24*e* of the second piece 24, forms the top surface of the club head 20*e*. The first piece 22 has a bottom surface 22*d*, which forms the sole 20*d* of the club head, and two side surfaces 20*b*, 20*c* extending rearwardly from the front striking surface 20*a* to an irregularly-shaped, stepped rear surface.

Referring to FIG. 3, a cavity 25 is formed in the rear surface of the first piece 22 into which the second piece 24 inserts and interlocks. The cavity 25 is formed by an end surface 22*g*, two opposed side surfaces 22*h*, and a bottom surface 22*i*. The end surface 22*g* extends generally parallel to the front surface 22*a* and generally parallel to the heel-to-toe axis 20*f*. The two side surfaces 22*h* extend from front to back generally perpendicular to the heel-to-toe axis 20*f*.

Each side surface 22*h* has a protruding rib 27 which extends generally perpendicular to the heel-to-toe axis. The opposes ribs 27 cooperate with a pair of opposed, linerly extending recesses 29 on the second piece 24. To interlock the first piece 22 and second piece 24, the ribs 27 insertably slide into the recesses 29 to assist in locking the two pieces 22, 24 together.

An elongate groove 31 having a semi-circular cross-section is formed in the end surface 22*g* of the first piece 22. The groove 31 extends along the width of the cavity 25. The groove 31 cooperates with a similar, opposed groove 33 formed in the mating surface 24*g* of the second piece 24 to form a generally cylindrical socket 26. As described below, the socket 26 houses a slide 50 which is linearly and rotatably movable in the socket to adjust the alignment and balance of the adjustable golf putter.

The second piece 24 has a top surface 24*e* which, together with the top surface 22*e* of the first piece 22, forms the top surface 20*e* of the club head 20. The second piece has an irregularly-shaped, stepped front surface 24*g* which shape compliments the irregularly-shaped, stepped rear surface of the first piece 22 including the end surface 22*g* and bottom surface 22*i* of the cavity of the first piece 22. Two side surfaces 24*b*, 24*c* extend rearwardly from the front surface 24*g* to the rear surface which, together with the rear surface of the front piece, form the rear surface of the club head.

An elongate groove 33 having a semi-circular cross-section is formed in the front surface 24*g* of the second piece 24. The groove 33 extends along the width of the front surface 24*g*. The groove 33 cooperates with a similar, opposed groove 31 formed in the end surface 24*g* of the first piece 22 to form a generally cylindrical socket 26. As described below, the socket 26 houses a slide 50 which is linearly and rotatably movable in the socket 26 to adjust the alignment and balance of the adjustable golf putter.

The club head has means for interlocking the first 22 and second 24 pieces which form the head 20 including the socket 26. The socket 26 has a diameter equal to or smaller than the diameter of the slide 50 when the interlocking means are tightened fully without the slide 50 being located in the socket 26.

As described above, the ribs 27 in the first piece 22 slidably engage the recesses 29 in the second piece 24 to hold the two pieces 22 and 24 together. To further prevent the two pieces from sliding apart, a set screw 42 is inserted through an aperture in the second piece 24 and into a threaded bore in the rear surface of the first piece 22 as best seen in FIG. 4.

The putter has connecting means 40 to connect the club head 20 to the connection end 30*a* of the shaft 30. The connecting means 40 is designed so that the alignment angle and the balance of the putter can be adjusted when the interlocking means is untightened.

The shaft 30 has a hosel 44 fixed to the connection end 30*a* of the shaft 30. Referring to FIG. 3, the hosel 44 includes a socket 46 at one end into which the connection end 30*a* of the shaft 30 is inserted and secured. The other end of the hosel 44 has a slide 50 which is designed to slide in the socket 26 formed between the first 22 and second 24 pieces of the club head.

In a preferred embodiment, the slide comprises a hollow, cylindrical segment 50 fixed to the hosel at an intermediate point along the lengthwise outer surface of the cylindrical segment 50. The length of the slide 50 is shorter than the length of the socket 26 and the diameter of the segment 50 is preferably slightly greater than or equal to the diameter of the socket 26. With this configuration, the slide 50 can be moved linearly in infinite incriments along the socket 26 to adjust the balance of the club, and rotated in infinite incriments in the socket to adjust the line-of-play alignment angle of the club, when the first 22 and second 24 pieces are not fully tightened. However, when the first 22 and second 24 pieces are fully tightened, linear and rotational movement of the slide 50 in the socket 26 are prevented, thereby locking the balance and line-of-play alignment angle selected by the golfer.

Figure 5:
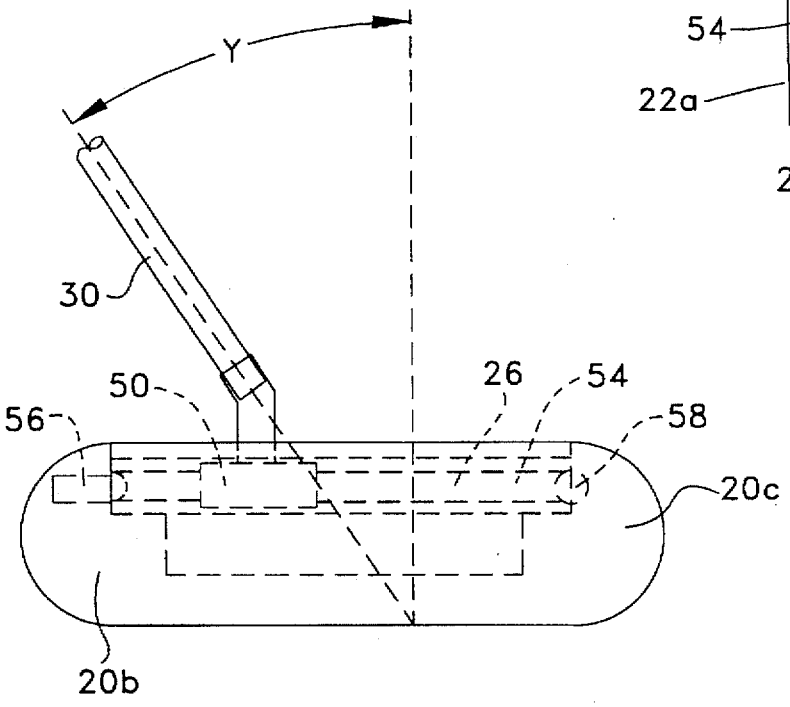
FIG. 5 is a front elevation of the putter head shown in FIG. 1, except that the putter head has been adapted to be used by a lefthanded golfer.

The cylindrical segment 50 is fixed to the hosel at an angle as seen in FIG. 5. This angle determines the heal-to-toe alignment angle "Y" of the putter as seen in FIG. 5. To conform with U.S.G.A. rules, the heel-to-toe angle "Y" is at least 10 degrees. Preferably, the heel-to-toe angle "Y" is slightly greater than 10 degrees.

When the first 22 and second 24 pieces are fully tightened, the mating surfaces 22*g* and 24*g* near the top surface 20*e* of the head 20 do not contact one another but rather form a slot 52 in the top surface of the club head along or parallel to the axis of the socket 26 as best seen in FIG. 1. The slot has a widthwise dimension larger than the diameter of the hosel 44 but smaller than the diameter of the slide 50. The front 52*a* and back 52*b* walls of slot 52 act as a stop for limiting adjustment of the line-of-play alignment angle of the shaft to plus or minus 20 degrees.

The club head preferably has a guide for guiding movement of the slide in the socket. The guide has a shape complimentary with said slide. Referring to FIGS. 3, and 5, preferably the guide comprises a cylindrical rod 54 having a diameter equal to or slightly smaller than the inner diameter of the cylindrical segment 50. The cylindrical rod 54 is secured at opposed ends in the socket 26 and extends along the central axis of the socket. The cylindrical rod 54 is preferably threaded on one end 54*a* and has a hex-head socket formed in the other end 54*b*. To secure the rod in place, the rod is inserted through a countersunk aperture 56 in one side of the first piece 22 and into a threaded bore 58 in the other side of the first piece 22. The cylindrical rod 54 can be tightened by applying torque to the hex-head socket formed at one end 54*a*.

Figure 6:
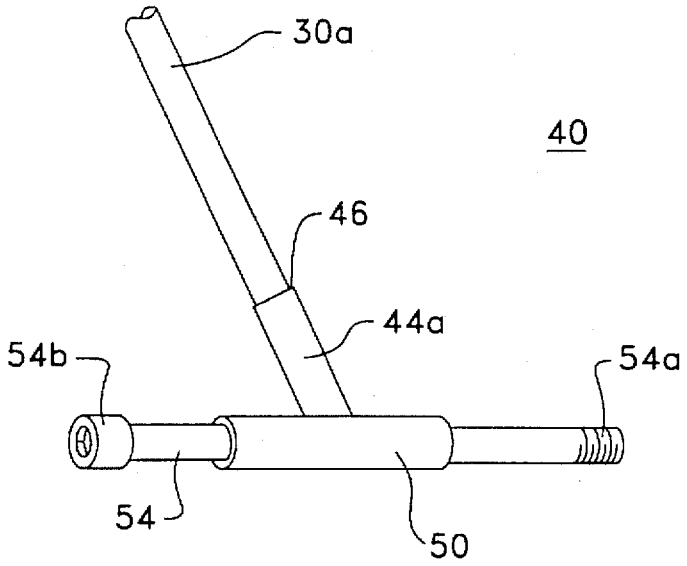
FIG. 6 is an enlarged perspective of an alternative hosel mounted on a slide.

FIG. 6 illustrates an alternative straight-on hosel 44*a*, which may be used in place of offset hosel 44 shown in FIGS. 1 and 3–5, having a slide 50 connected thereto and slidably mounted on rod 54.

Figure 7:
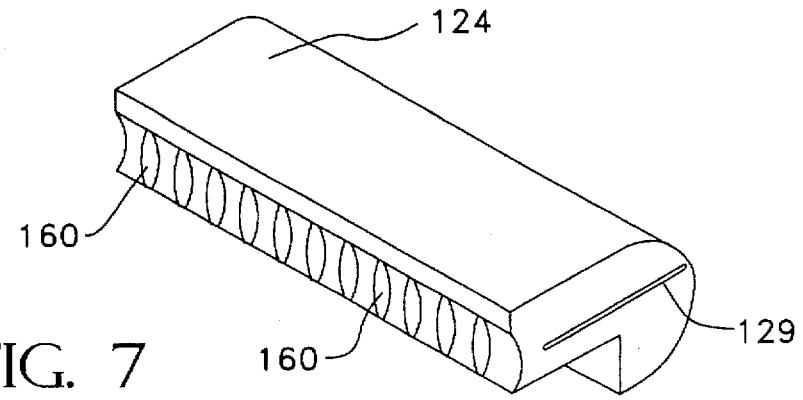
FIG. 7 is a perspective view of the back or second piece of the putter head of an alternative embodiment of the invention having a notched socket in the putter head.
Figure 8:
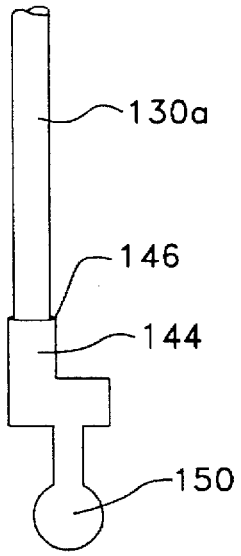
FIG. 8 is an enlarged perspective of a hosel and slide of another alternative embodiment of the invention.

In an alternative embodiment of the invention illustrated in FIGS. 7 and 8, the slide comprises a sphere 150 fixed to a hosel 144. In this embodiment, the diameter of the sphere is equal to or slightly larger than the diameter of the socket 126 so that the sphere is linearly and rotationally movable in the socket 126 when the interlocking means are untightened, but is not movable when the interlocking means are tightened.

In this embodiment, the socket 126 does not have a guide 54 but may have regularly-spaced notches 160 into which the sphere 150 may be located to provide predetermined incremental adjustment of the sphere along the socket 126.

Figure 9:
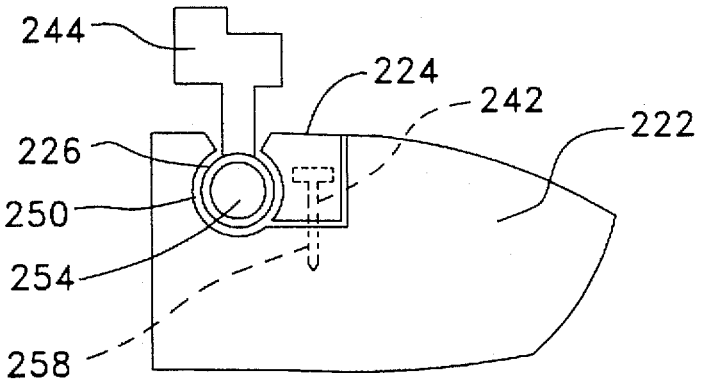
FIG. 9 is a cross-section of a putter head of another alternative embodiment of the invention.
Figure 10:
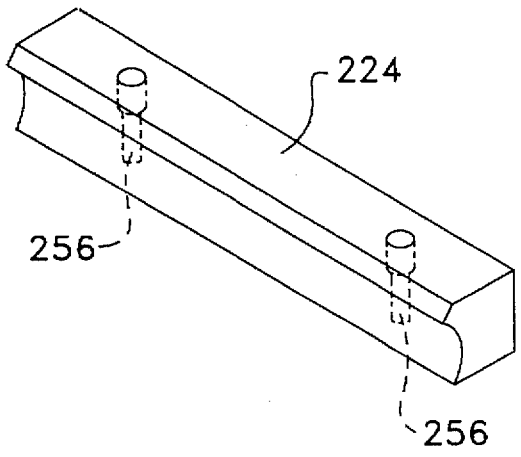
FIG. 10 is a perspective view of the back or record piece of the putter head shown in FIG. 9.

In another alternative embodiment of the invention illustrated in FIGS. 9 and 10, the slide comprises a hollow, cylindrical segment 250 affixed to a hosel 244 at an intermediate point along the lengthwise outer surface of the segment 250. The second piece 224 of the head comprises an elongate, irregularly-shaped bar as best seen in FIG. 10. The bar 224 cooperates with the first piece 222 to form a socket 226 into which the slide 250 is inserted and secured.

The club head of the embodiment shown in FIGS. 9 and 10 has means for interlocking the first 222 and second 224 pieces which form the head including the socket 226. To interlock the first 222 and second 224 pieces, set screws 242 are inserted through countersunk apertures 256 in the second piece and into threaded bores 258 in the first piece 222.

In another alternative embodiment, the slide illustrated in FIG. 9 comprises a sphere such as illustrated in FIG. 8. In this embodiment, the second piece 224 preferably includes regularly-spaced notches along its length into which the sphere may be located to provide predetermined incremental adjustment of the sphere along the socket.

In another alternative embodiment, the embodiments of the putters described above may be reversible to accommodate either a left or right handed golfer. Referring to FIGS. 1 and 3, the head of the club is symmetrical about an axis extending along the line of play, i.e., perpendicular to the heel-to-toe axis 20*f*. Therefore, the heel 20*b* and toe 20*c* of the head are defined above relative to the heel-to-toe alignment angle of the shaft. If, however, the shaft is removed from the head by disassembling the first and second pieces of the head, the shaft can be reaffixed to the head in a reverse orientation.

Referring to FIG. 1, the heel 20*b* and toe 20*c* are shown on a putter having the shaft assembled for use by a right-handed golfer. However, the shaft can also be assembled for use by a left-handed golfer as seen in FIGS. 3 and 5 by rotating the shaft 180 degrees about the lengthwise axis of the shaft. When the hosel and shaft are rotated 180 degrees and reassembled to the head, the heel and toe are reversed and redefined accordingly.

In the method of the present invention, the adjustable golf club substantially as described above is provided to a golfer. The golfer adjusts the balance of the golf club and the line-of-play alignment angle of the golf club by first untightening the means for interlocking the first 22, 122, 222 and second 24, 124, 224 pieces which form the club head. The interlocking means may be loosened to merely adjust the balance and/or line-of-play alignment angle of the club, or may be removed completely to reverse the orientation of the connecting means to change the club from a left-handed orientation to a right-handed orientation, and visa-versa. The balance of the club is adjusted by linearly moving the slide 50, 150, 250 forward or backward in the socket 26 until the desired balance is obtained. The line-of-play alignment angle of the shaft of the golf club is adjusted by rotating the slide 50, 150, 250 in the socket until the desired line-of-play alignment angle is achieved. After the club head is adjusted as desired by the golfer, the interlocking means are then tightened to secure the club in the desired adjusted position. The golfer may then putt golf balls throughout a round of golf without deviation from the desired adjusted position.

It will be apparent to those skilled in the art that the invention disclosed herein may be embodied in other specific forms without departing from the spirit and scope thereof. Accordingly, the disclosure of the present invention is intended to be illustrative, but not limiting of the scope of the invention that is set out in the following claims.

We claim:

1. An adjustable golf club comprising:

A) a club head having a ball striking surface, a heel, a toe, a sole, a top surface, and a heel-to-toe axis;

B) a shaft having a grip end and a connection end;

C) means for connecting the shaft to the club head at a connection point along the heel-to-toe axis and at a line-of-play alignment angle and a heel-to-toe alignment angle;

D) balance adjustment means for adjusting the connection point of the club head in infinite increments along the heel-to-toe axis of the club to adjust the balance of the club head;

E) alignment adjustment means for adjusting the line-of-play alignment angle of the shaft in infinite increments: and G) means for limiting adjustment of the line-of-play alignment angle of said club within the ranges specified by the U.S.G.A. rules of golf.

2. The adjustable golf club recited in claim 1, said connecting means comprising a slide fixed to the connection end of said shaft and an elongate socket in the top portion of said club head, said socket having an axis that extends along or is parallel to the heel-to-toe axis.

3. The adjustable golf club recited in claim 2, said socket and slide having complimentary shapes.

4. The adjustable golf club recited in claim 2, said connecting means including clamping means for preventing linear or rotational movement of said slide in said socket.

5. The adjustable golf club recited in claim 4, said clamping means including a set screw having a fixed location on said club head.

6. The adjustable golf club recited in claim 2, said club head comprising a first piece and a second piece forming a two-piece, interlocking construction, each piece having a groove formed on opposed mating surfaces along the heel-to-toe axis, said socket being formed by said grooves when said first and second pieces are interlocked.

7. The adjustable golf club recited in claim 6, including means for interlocking said first and second pieces forming said socket, said socket having a diameter equal to or smaller than the diameter of said slide when said interlocking means are tightened fully without said slide being located in the socket.

8. The adjustable golf club recited in claim 2, said socket including a lengthwise slot formed in the top surface of the club head along or parallel to the axis of said socket, said slot having a widthwise dimension larger than the diameter of the connecting end of said shaft but smaller than the diameter of said slide.

9. The adjustable golf club recited in claim 2, said connecting means including a stop for limiting adjustment of the line-of-play alignment angle of the shaft to plus or minus 20 degrees.

10. The adjustable golf club recited in claim 9, said stop comprising a slot formed in the top surface of the club head along or parallel to the axis of the socket.

11. The adjustable golf club recited in claim 2, said slide orienting said shaft at a heel-to-toe alignment angle of 10 degrees or greater.

12. The adjustable golf club recited in claim 1, said connecting means, balance adjustment means, and alignment adjustment means comprising a slide fixed to the connection end of said shaft and an elongate socket in the top portion of said club head, said socket having an axis that extends along or is parallel to the heel-to-toe axis.

13. An adjustable golf club comprising,

A) a club head having a ball striking surface, a heel, a toe, a sole, a top surface, and a heel-to-toe axis;

B) a shaft having a grip end and a connection end;

C) means for connecting the shaft to the club head at a connection point along the heel-to-toe axis and at a line-of-play alignment angle and a heel-to-toe alignment angle;

D) balance adjustment means for adjusting the connection point of the club head in infinite increments along the heel-to-toe axis of the club to adjust the balance of the club head; and E) alignment adjustment means for adjusting the line-of-play alignment angle of the shaft in infinite increments, said shaft having a hosel with a protruding segment fixed to the connection end of said shaft, and a substantially cylindrical socket in the top portion of said club head, said segment having an outer surface profile that compliments said socket, said socket having a length greater than the length of said cylindrical segment and a central axis that extends along or is parallel to the heel-to-toe axis.

14. The adjustable golf club recited in claim 13 including a guide for guiding movement of said segment in said socket.

15. The adjustable golf club recited in claim 14, said guide comprising a cylindrical rod fixed in said socket at opposed ends and extending along the central axis of said socket, said guide having a shape complimentary with said segment.

16. The adjustable golf club recited in claim 15, said segment being cylindrical and having a hollow, cylindrical inner surface with a diameter greater than or equal to the diameter of the cylindrical rod.

17. The adjustable golf club recited in claim 13, said segment being spherical, said socket having a length greater than the diameter of said spherical segment.

18. An adjustable golf club comprising:

A) a club head having a ball striking surface, a heel, a toe, a sole, a top surface, and a heel-to-toe axis;

B) a shaft having a grip end and a connection end;

C) means for connecting the shaft to the club head at a connection point along the heel-to-toe axis and at a line-of-play alignment angle and a heel-to-toe alignment angle;

D) balance adjustment means for adjusting the connection point of the club head in infinite increments along the heel-to-toe axis of the club to adjust the balance of the club head; and E) alignment adjustment means for adjusting the line-of-play alignment angle of the shaft in infinite increments, the connecting means comprising a slide fixed to the connection end of said shaft and an elongate socket in the top portion of said club head, said socket having an axis that extends along or is parallel to the heel-to-toe axis, said socket and slide having complimentary shapes, said shaft having a hosel with a protruding cylindrical segment fixed to the connection end of said shaft, and a substantially cylindrical socket in the top portion of said club head, said socket having a length greater than the length of said cylindrical segment and a central axis that extends along or is parallel to the heel-to-toe axis, including a guide for guiding movement of said slide in said socket, said guide comprising a cylindrical rod fixed in said socket at opposed ends and extending along the central axis of said socket, said guide having a shape complimentary with said slide, said cylindrical segment having a hollow, cylindrical inner surface with a diameter greater than or equal to the diameter of the cylindrical rod, said connecting means further including clamping means for preventing linear or rotational movement of said slide in said socket, said club head comprising a first piece and a second piece forming a two-piece, interlocking construction, each piece having a groove formed on opposed mating surfaces along the heel-to-toe axis, said socket being formed by said grooves when said first and second pieces are interlocked, and further including means for interlocking said first and second pieces forming said socket, said socket having a diameter equal to or smaller than the diameter of said slide when said interlocking means are tightened fully without said slide being located in the socket, said socket including a lengthwise slot formed in the top surface of the club head along or parallel to the axis of said socket, said slot having a widthwise dimension larger than the diameter of the connection end of said shaft but smaller than the diameter of said slide, said connecting means further including a stop for limiting adjustment of the line-of-play alignment angle of the shaft to plus or minus 20 degrees, said stop comprising a slot formed in the top surface of the club head along or parallel to the axis of the socket, and said slide orienting said shaft at a heel-to-toe alignment angle of 10 degrees or greater.

19. A reversible golf club comprising:

A) a club head having a ball striking surface, a heel, a toe, a sole, a top surface, and a heel-to-toe axis, and a line-of-play axis generally perpendicular to said heel-to-toe axis, said club head being symmetrical about said line-of-play axis;

B) a shaft having a grip end and a connection end;

C) means for connecting the shaft to the club head at an alignment angle along the heel-to-toe axis, said alignment angle being measured from the heel of the head;

D) adjustment means for reversing the orientation of the club by reversing said shaft to said same alignment angle;

E) balance adjustment means for adjusting the connection point of the club head in infinite increments along the heel-to-toe axis of the club to adjust the balance of the club head;

F) alignment adjustment means for adjusting the line-of-play alignment angle of the shaft in infinite increments; and G) means for limiting adjustment of the line-of-play alignment angle of said club within the ranges specified by the U.S.G.A. rules of golf.

20. The reversible golf club recited in claim 18, said connecting means comprising a slide fixed to the connection end of said shaft and an elongate socket in the top portion of said club head, said socket having an axis that extends along or is parallel to the heel-to-toe axis.

21. A method of putting a golf ball with an adjustable golf club having balance adjustment means for adjusting the connection point of the club head along the heel-to-toe axis, line-of-play alignment angle adjustment means for adjusting the line-of-play alignment angle of the shaft in infinite increments, and means for limiting adjustment of the line-of-play alignment angle of said club within the ranges specified by the U.S.G.A. rules of golf, comprising the steps of:

a) adjusting the balance of said club;

b) adjusting the line-of-play alignment angle of said golf club;

c) limiting adjustment of the line-of-play alignment angle within the ranges specified by the U.S.G.A. rules of golf; and d) striking the golf ball with said club.

* * * * *